US011770654B2

(12) United States Patent
Liang et al.

(10) Patent No.: US 11,770,654 B2
(45) Date of Patent: Sep. 26, 2023

(54) SPEAKER DEVICE

(71) Applicant: AAC Microtech (Changzhou) Co., Ltd., Changzhou (CN)

(72) Inventors: Ping Liang, Shenzhen (CN); Bin Zhao, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 49 days.

(21) Appl. No.: 17/542,523

(22) Filed: Dec. 6, 2021

(65) Prior Publication Data

US 2022/0191619 A1 Jun. 16, 2022

(30) Foreign Application Priority Data

Dec. 16, 2020 (CN) ..... 202023042829.8

(51) Int. Cl.
*H04R 9/02* (2006.01)

(52) U.S. Cl.
CPC ..... *H04R 9/025* (2013.01); *H04R 2400/11* (2013.01)

(58) Field of Classification Search
CPC ..... H04R 9/06; H04R 29/001; H04R 7/10; H04R 3/007; H04R 2499/11
See application file for complete search history.

(56) References Cited

U.S. PATENT DOCUMENTS

2019/0297425 A1* 9/2019 Huang ..... H04R 7/18
2020/0045436 A1* 2/2020 Zhang ..... H04R 31/006

FOREIGN PATENT DOCUMENTS

CN 211531292 U * 9/2020

* cited by examiner

*Primary Examiner* — Paul C McCord
*Assistant Examiner* — Julie X Dang
(74) *Attorney, Agent, or Firm* — W&G Law Group

(57) ABSTRACT

The present disclosure provides speaker device. speaker device includes frame, vibration unit fixed to frame and magnetic circuit unit driving vibration unit to vibrate and produce sound, where magnetic circuit unit is provided with magnetic gap; vibration unit includes diaphragm fixed to frame, holder fixed to diaphragm by injection molding and voice coil inserted in magnetic gap and connected to holder; holder includes bottom wall that is fixed to diaphragm and provided with pair of long edges and pair of short edges, and pair of side walls bending and extending from outer peripheries of short edges of bottom wall to magnetic circuit unit; side walls each are provided with chamfered portions on sides close to long edges. Present disclosure solves problem of deformation of holder molded in mold, thereby improving evenness of holder after molding.

7 Claims, 8 Drawing Sheets

A–A

B–B

SPEAKER DEVICE

TECHNICAL FIELD

The present disclosure relates to the field of electro-acoustic conversion, in particular to a speaker device.

BACKGROUND

With the advent of the Internet era, the number of mobile terminal devices continues to rise. Mobile phones are undoubtedly the most common and most portable mobile terminal devices. Speaker devices are widely used in mobile terminal devices such as mobile phones for playing music, etc. The vibration unit is an important part of the speaker device, which enables the entire speaker device to vibrate and produce sound.

In the related art, a speaker device includes a frame, a vibration unit fixed to the frame and a magnetic circuit unit driving the vibration unit to vibrate and produce sound. The vibration unit includes a diaphragm, a voice coil inserted in a magnetic gap to drive the diaphragm to vibrate, a holder connected to the diaphragm and supporting and suspending the voice coil under the diaphragm and an elastic conductive pad connected to a side of the holder away from the diaphragm. The voice coil includes a lead wire electrically connected to the elastic conductive pad. The magnetic circuit unit includes a yoke and a magnet fixed to the yoke. The magnet includes a main magnet and an auxiliary magnet forming the magnetic gap with the main magnet.

The holder includes a bottom wall and a side wall bending and extending from the bottom wall to the magnetic circuit unit. When the holder is molded in a mold, it is prone to deform, resulting in unevenness of the holder after molding.

Therefore, it is necessary to provide a speaker device to solve the above problem.

SUMMARY

An objective of the present disclosure is to provide a speaker device, which effectively solves the problem of deformation of a holder molded in a mold.

In order to achieve the above objective, the present disclosure provides a speaker device. The speaker device includes a frame, a vibration unit fixed to the frame and a magnetic circuit unit driving the vibration unit to vibrate and produce sound, where the magnetic circuit unit is provided with a magnetic gap; the vibration unit includes a diaphragm fixed to the frame, a holder fixed to the diaphragm by injection molding and a voice coil inserted in the magnetic gap and connected to the holder; the holder includes a bottom wall that is fixed to the diaphragm and provided with a pair of long edges and a pair of short edges, and a pair of side walls, each of the pair of side walls bends and extends from an outer periphery of one of the pair of short edges of the bottom wall towards the magnetic circuit unit; each of the pair of side walls is provided with a chamfered portion on a side close to one of the pair of long edge; each of the pair of side walls includes a bottom portion close to the bottom wall and a top portion away from the bottom wall; and the chamfered portion comprises a chamfered edge extending obliquely from the top portion to the bottom portion.

As an improvement, the chamfered portion may be further provided with a notch spaced apart from the chamfered edge; and the notch may be provided on a side of the chamfered edge close to the bottom portion.

As an improvement, the bottom wall may be ring-shaped; the holder may further include a connecting portion bending and extending from an inner periphery of the bottom wall to the magnetic circuit unit; the voice coil may be fixed to and connected to the connecting portion; and the bottom wall, the pair of side walls, the connecting portion and the voice coil may together define an accommodating space.

As an improvement, the diaphragm may include a vibrating portion provided with a through hole, a suspension portion extending from an outer periphery of the vibrating portion and surrounding the vibrating portion, a fixing portion bending and extending from a side of the suspension portion away from the vibrating portion and fixed to the frame, and a dome located in the through hole; and the bottom wall may connect the vibrating portion and the dome.

As an improvement, the vibrating portion may include a gluing member that may be provided at a position corresponding to the chamfered portions and bend and extend to the magnetic circuit unit; the gluing member may be provided with a fixing post that may be provided at a position corresponding to the notch and extends towards the notch; the gluing members may be fixed to and connected to the chamfered portions; and the fixing post may be accommodated in the notch.

As an improvement, the vibration unit may further include an elastic conductive assembly fixed to the frame and an end of the holder away from the diaphragm; the elastic conductive assembly may include an elastic conductive body connected to the frame and an end of one of the pair of side wall away from the diaphragm, a connecting arm bending and extending from the elastic conductive body into the accommodating space along one of the pair of side wall and a pad connected to the connecting arm; and the pad may be fixed to and connected to a side of the bottom wall away from the diaphragm.

As an improvement, the connecting arm may include a first bending portion bending and extending from the elastic conductive body to the bottom wall and a second bending portion bending and extending from the first bending portion to the voice coil; the first bending portion and one of the pair of side walls may be spaced apart in parallel; and the second bending portion and the pad may be respectively connected to a side of the bottom wall away from the diaphragm.

As an improvement, the magnetic circuit unit may include a yoke, a main magnet fixed to the yoke, a peripheral magnet surrounding the main magnet and spaced apart from the main magnet to form the magnetic gap, a first magnetic conductor fixedly covering the main magnet and a second magnetic conductor fixedly covering the peripheral magnet; the second magnetic conductor may be fixed to and connected to a side of the frame away from the diaphragm; and the second magnetic conductor may be provided with an avoiding portion at a position corresponding to the pad.

Compared with the related art, in the present disclosure, the ends of each of the side walls of the holder are provided with chamfered edges. The design of the chamfered edges solves the problem of deformation of the holder molded in a mold, and improves the evenness of the holder after molding, thereby facilitating the placement of the holder into the mold. In addition, due to the chamfered edges, during the integral molding process of the holder and the diaphragm, the chamfered portions can accommodate the overflowing plastic, which solves the problems of material extrusion and accumulation at two ends of the side walls and the resulting diaphragm breakage in the prior art, thereby improving the yield.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those of ordinary skill in the art based on the embodiments in the present disclosure without creative efforts should fall within the protection scope of the present disclosure.

Figure 1:
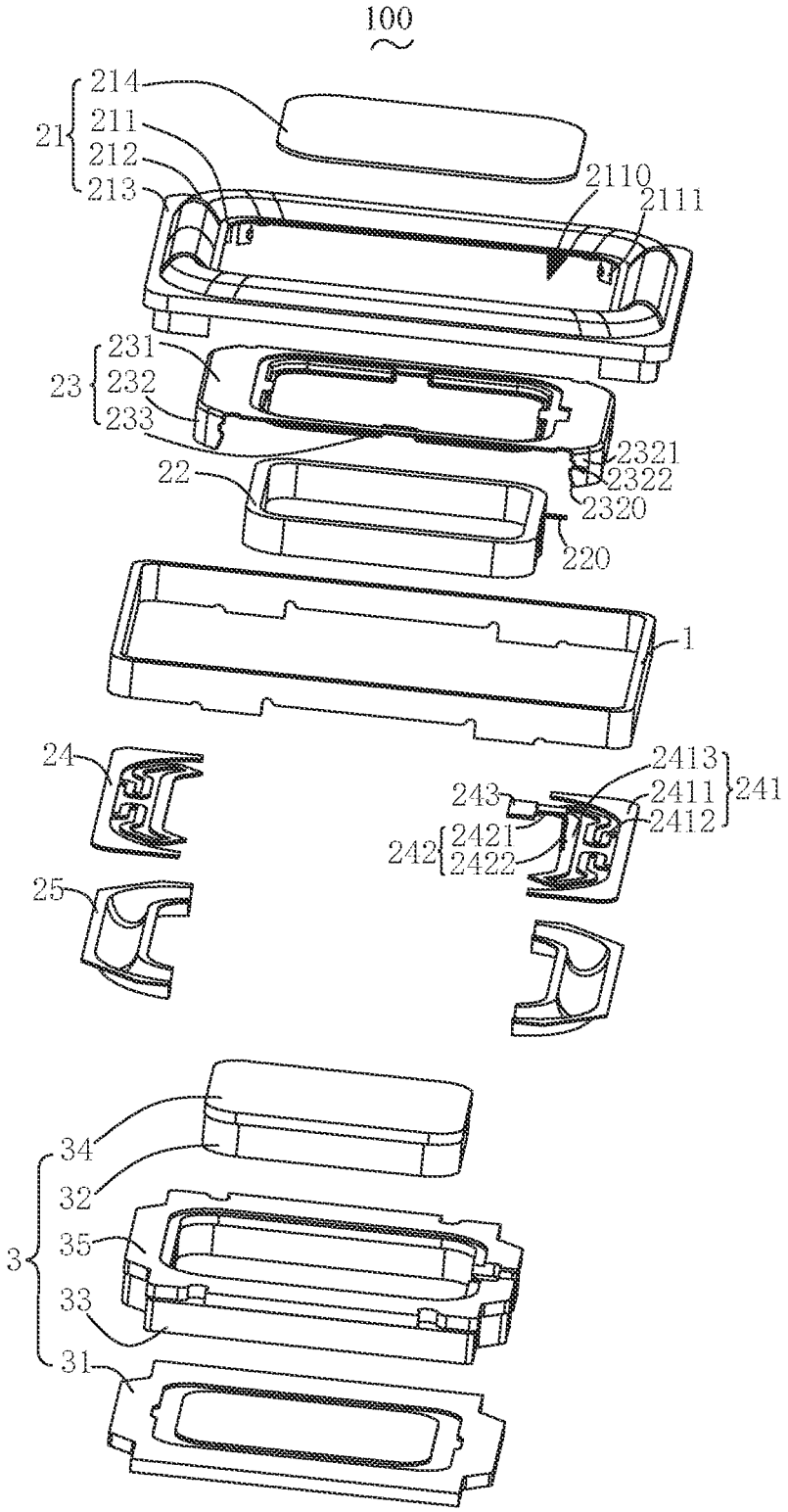
FIG. 1 is an exploded view illustrating a structure of a speaker device according to the present disclosure.
Figure 2:
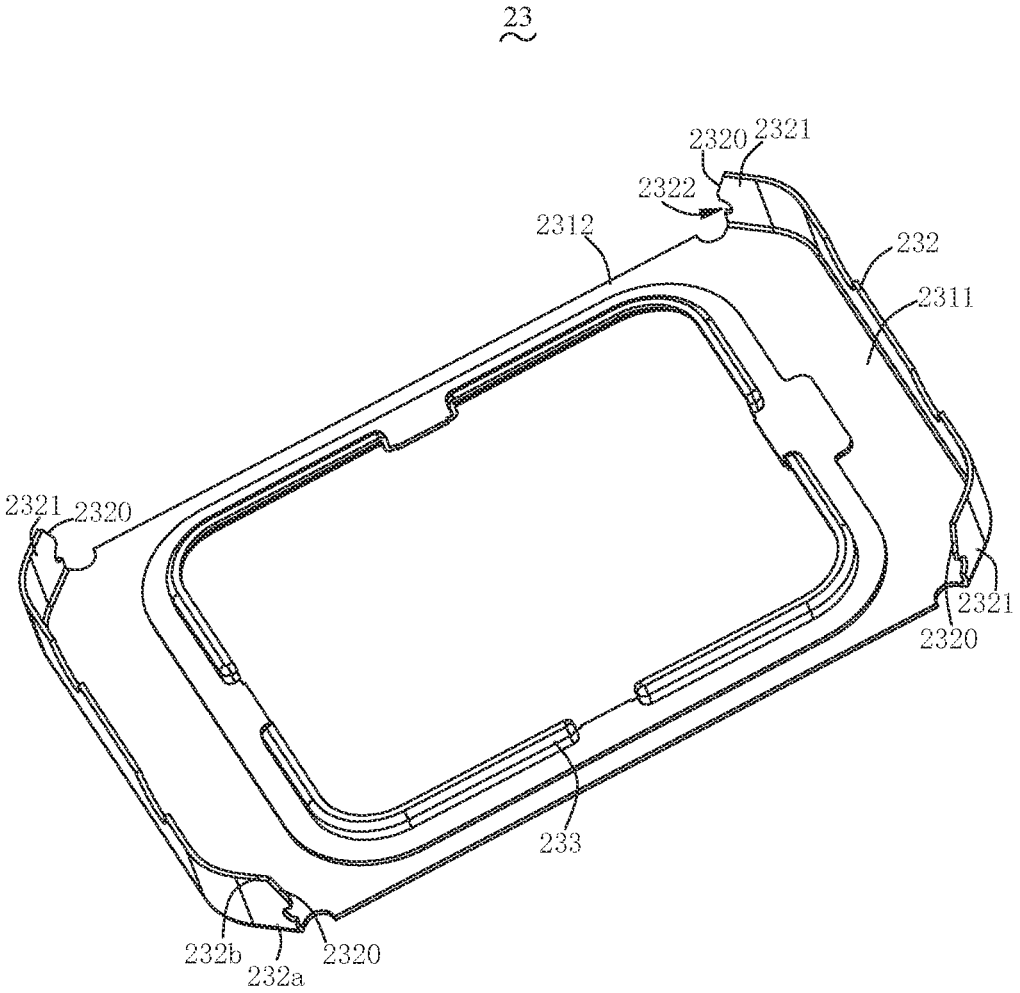
FIG. 2 is a view illustrating a structure of a holder of the speaker device according to the present disclosure.
Figure 3:
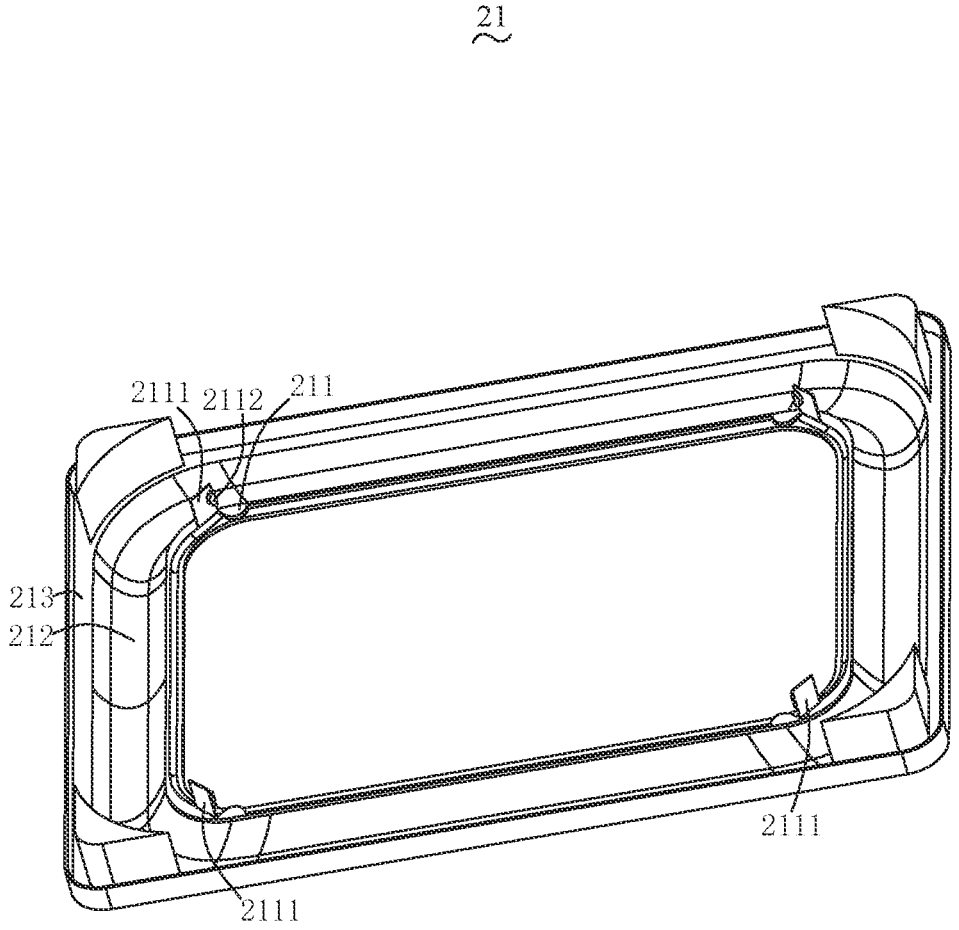
FIG. 3 is a view illustrating a structure of a diaphragm of the speaker device according to the present disclosure.
Figure 4:
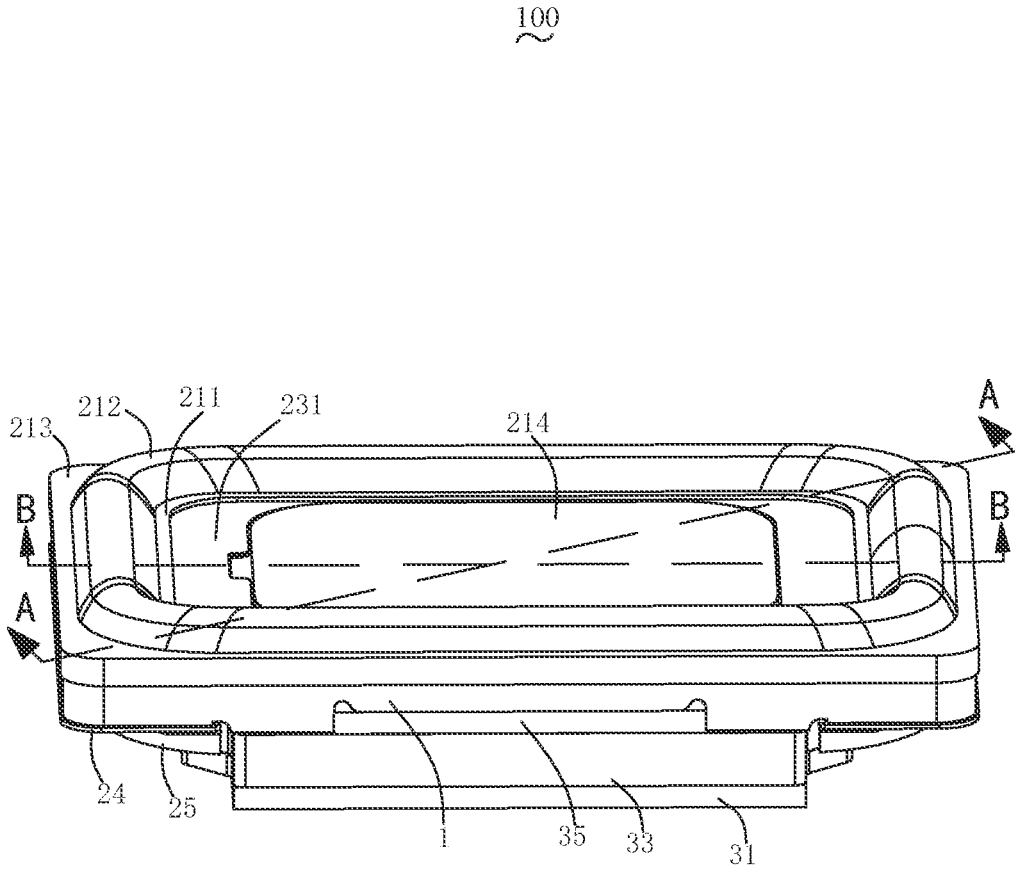
FIG. 4 is a three-dimensional view illustrating a structure of the speaker device according to the present disclosure.
Figure 5:
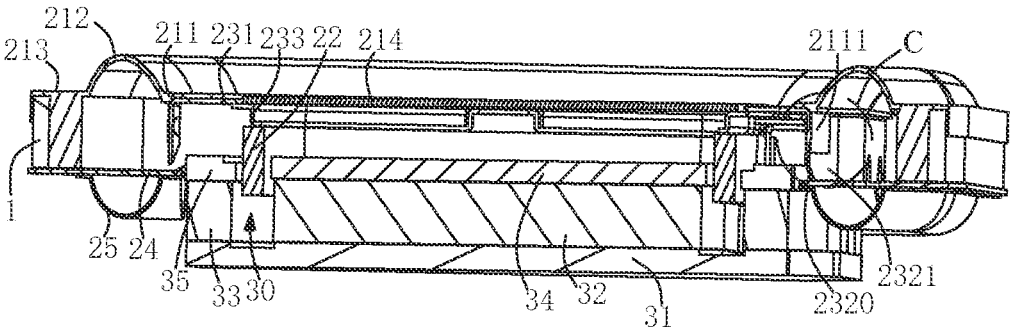
FIG. 5 is a sectional view taken along line A-A in FIG. 4.
Figure 6:
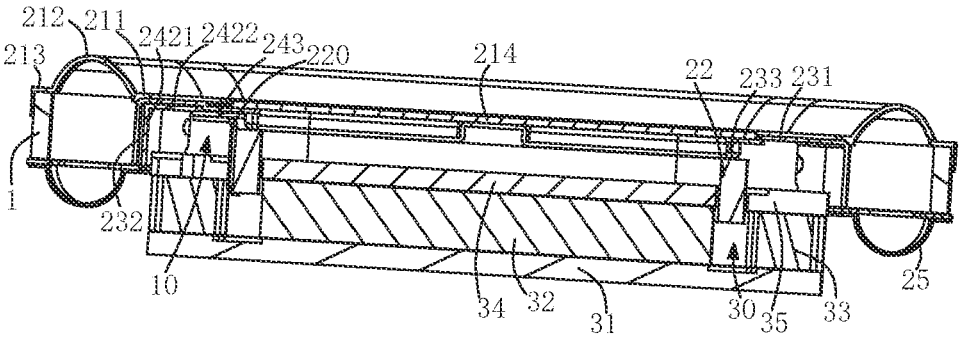
FIG. 6 is a sectional view taken along line B-B in FIG. 4.
Figure 7:
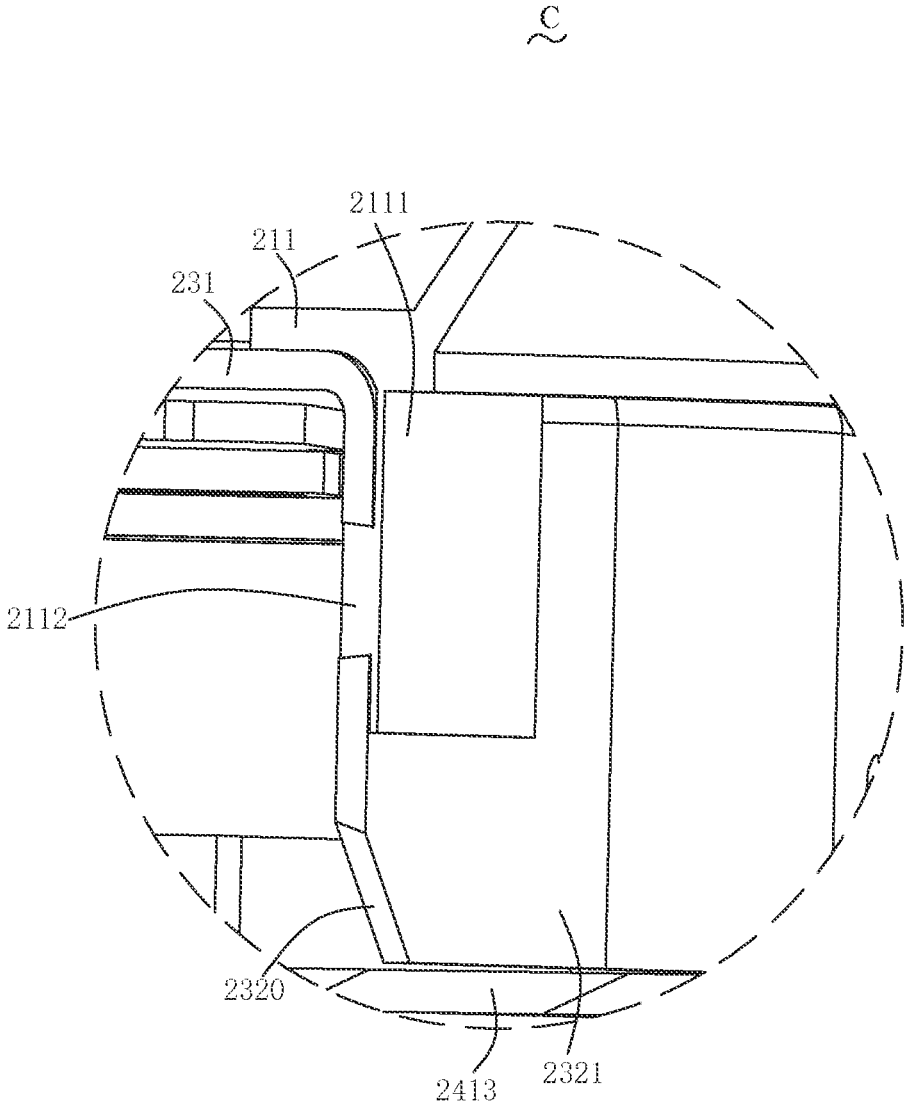
FIG. 7 is an enlarged view of C in FIG. 5.
Figure 8:
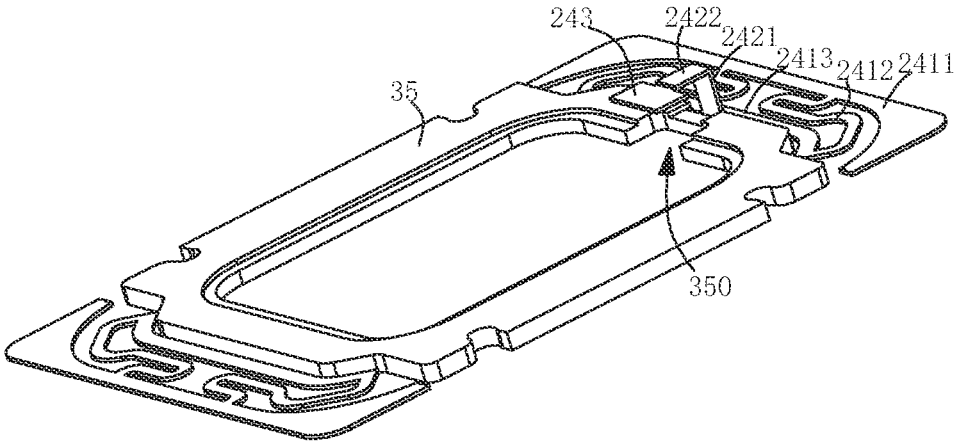
FIG. 8 is a view of a second magnetic conductor and elastic conductive assembly of the speaker device after assembly according to the present disclosure.

Referring to FIGS. 1 to 8, the present disclosure provides a speaker device 100. The speaker device 100 includes a frame 1, a vibration unit fixed to the frame 1 and a magnetic circuit unit 3 driving the vibration unit to vibrate and produce sound. The magnetic circuit unit 3 is provided with a magnetic gap 30.

Specifically, the vibration unit includes a diaphragm 21 fixed to the frame 1, a voice coil 22 inserted in the magnetic gap 30 to drive the diaphragm 21 to vibrate, a holder 23 connected to the diaphragm 21, elastic conductive assembly 24 fixed to the frame 1 and connected to a side of the holder 23 away from the diaphragm 21 and an auxiliary diaphragm 25 fixed to a side of the elastic conductive assembly 24 away from the diaphragm 21. The holder 23 and the voice coil 22 define an accommodating space 10.

The holder 23 includes a ring-shaped bottom wall 231 fixed to the diaphragm 21, a side wall 232 bending and extending from an outer periphery of the bottom wall 231 to the magnetic circuit unit 3 and a connecting portion 233 bending and extending from an inner periphery of the bottom wall 231 to the magnetic circuit unit 3. The bottom wall 231 includes a pair of short edges 2311 and a pair of long edges 2312. The side wall 232 is formed by bending and extending outer periphery of one the pair of short edges 2311 toward the magnetic circuit unit 3.

Specifically, there are two side walls 232, which are arranged oppositely and spaced apart. Each of the side walls 232 includes a bottom portion 232*a* close to the bottom wall 231 and a top portion 232*b* away from the bottom wall 231. Two ends of each of the side walls 232 close to long edges 2312 are provided with chamfered portions 2321. A side of each of the chamfered portions 2321 away from the bottom wall 231 is provided with a chamfered edge 2320 extending obliquely from the top portion 232*b* to the bottom portion 232*a*. A notch 2322 is spaced apart from the chamfered edge 2320. The gap 2322 is provided on a side of the chamfered edge 2320 close to the bottom portion 232*a*. An end of the side wall 232 away from the diaphragm 21 is connected to the elastic conductive assembly 24. The connecting portion 233 is connected to an end of the voice coil 22 toward the diaphragm 21. The design of the chamfered edge solves the problem of deformation of the holder molded in a mold, and improves the evenness of the holder after molding, thereby facilitating the placement of the holder into the mold. In addition, due to the chamfered edge, during the integral molding process of the holder and the diaphragm, the chamfered portion can accommodate the overflowing plastic, which solves the problems of material extrusion and accumulation at two ends of the side wall and the resulting diaphragm breakage in the prior art, thereby improving the product yield.

The side wall 232 is spaced apart from the voice coil 22. The bottom wall 231, the side wall 232, the connecting portion 233 and the voice coil 22 together define the accommodating space 10.

The diaphragm 21 includes a vibrating portion 211 provided with a through hole 2110, a suspension portion 212 extending from a periphery of the vibrating portion 211 and surrounding the vibrating portion 211, a fixing portion 213 bending and extending from a side of the suspension portion 212 away from the vibrating portion 211 and fixed to the frame 1 and a dome 214 fixed to a side of the bottom wall 231 away from the magnetic circuit unit 3 and located in the through hole 2110. The vibrating portion 211 surrounds and is spaced apart from the dome 214. The bottom wall 231 connects the vibrating portion 211 and the dome 214 into an integral structure, which is highly reliable.

Specifically, the vibrating portion 211 is fixed to and connected to the bottom wall 231. The vibrating portion 211 includes a gluing member 2111 that is provided at a position corresponding to the chamfered portion 2321 and bends and extends to the magnetic circuit unit 3. The gluing member 2111 is attached outside the chamfered portion 2321. Each of The gluing members 2111 includes a fixing post 2112 that is provided at a position corresponding to the notch 2322 and extends into the notch 2322. The gluing member 2111 is fixed to and connected to the chamfered portion 2321. The fixing post 2112 is accommodated in the notch 2322. The design of the chamfered portion 2321 and the gluing member 2111 increases the adhesive force between the diaphragm 21 and the holder 23, thereby improving the reliability of the speaker device 100.

One end of the frame 1 is fixed to the fixing portion 213, and the other end thereof is connected to the elastic conductive assembly 24.

The voice coil 22 is racetrack-shaped and is provided with two lead wires 220.

There are two elastic conductive assemblies 24. The elastic conductive assembly 24 each include an elastic conductive body 241 fixed to the frame 1 and connected to an end of a side wall 232 away from the diaphragm 21, a connecting arm 242 bending and extending into the accommodating space 10 along the holder 23 from the elastic conductive body 241 and a pad 243 connected to the connecting arm 242. The lead wires 220 are fixedly electrically connected to a side of the pad 243 away from the diaphragm 21.

Specifically, the elastic conductive body 241 includes a first body portion 2411 fixed to a side of the frame 1 away from the diaphragm 21, a second body portion 2413 fixed to an end of the side wall 232 away from the diaphragm 21 and two elastic arms 2412 connecting the first body portion 2411 and the second body portion 2413.

The connecting arm 242 includes a first connecting arm 2421 that bends and extends from a middle part of the second body portion 2413 to the bottom wall 231 along the side wall 232 and is located in the accommodating space 10 and a second connecting arm 2422 that bends and extends from the first connecting arm 2421 to the voice coil 22 along the bottom wall 231. The pad 243 is connected to the second connecting arm 2422.

The first connecting arm 2421 and the side wall 232 are spaced apart in parallel. The second connecting arm 2422 and the pad 243 are attached to a side of the bottom wall 231 toward the voice coil 22.

There are two auxiliary diaphragms 25, which are attached to the side of the elastic conductive assembly 24 away from the diaphragm 21.

The magnetic circuit unit 3 includes a yoke 31, a main magnet 32 fixed to the yoke 31, a peripheral magnet 33 surrounding the main magnet 32 and spaced apart from the main magnet 32 to form the magnetic gap 30, a first magnetic conductor 34 fixedly covering the main magnet 32 and a second magnetic conductor 35 fixedly covering the peripheral magnet 33. The second magnetic conductor 35 is fixed to and connected to the side of the frame 1 away from the diaphragm 21. The second magnetic conductor 35 is provided with an avoiding portion 350 at a position corresponding to the pad 243. When the speaker device vibrates and produces sound, the second magnetic conductor 35 will not collide with the pad 243, so as to avoid affecting the electrical connection between the pad 243 and the lead wires 220, thereby improving the safety of the speaker device.

Compared with the related art, in the present disclosure, two ends of each of the side walls of the holder are provided with chamfered edges. The design of the chamfered edge solves the problem of deformation of the holder molded in a mold, and improves the evenness of the holder after molding, thereby facilitating the placement of the holder into the mold. In addition, due to the chamfered edges, during the integral molding process of the holder and the diaphragm, the chamfered portion can accommodate the overflowing plastic, which solves the problems of material extrusion and accumulation at two ends of the side wall and the resulting diaphragm breakage in the prior art, thereby improving the yield.

The above described are merely embodiments of the present disclosure, which are not intended to limit the scope of the patent of the present disclosure. Any equivalent structure or process change made based on the specification and drawings of the present disclosure, or direct or indirect application thereof in other related technical fields, should fall within the protection scope of the patent of the present disclosure.

What is claimed is:

1. A speaker device, comprising a frame, a vibration unit fixed to the frame and a magnetic circuit unit driving the vibration unit to vibrate and produce sound, wherein the magnetic circuit unit is provided with a magnetic gap, and the vibration unit comprises a diaphragm fixed to the frame, a holder fixed to the diaphragm by injection molding, and a voice coil inserted in the magnetic gap and connected to the holder; and the holder comprises a bottom wall that is fixed to the diaphragm and provided with a pair of long edges and a pair of short edges, and a pair of side walls, each of the pair of side walls bends and extends from an outer periphery of one of the pair of short edges of the bottom wall toward the magnetic circuit unit; each of the pair of side walls is provided with a chamfered portion on a side close to one of the pair of long edges; each of the pair of side walls comprises a bottom portion close to the bottom wall and a top portion away from the bottom wall; and the chamfered portion comprises a chamfered edge extending obliquely from the top portion toward the bottom portion; wherein the bottom wall is ring-shaped; the holder further comprises a connecting portion bending and extending from an inner periphery of the bottom wall toward the magnetic circuit unit the voice coil is fixed to and connected to the connecting portion; and the bottom wall, the pair of side walls, the connecting portion and the voice coil together define an accommodating space.

2. The speaker device as described in claim 1, wherein the chamfered portion is further provided with a notch spaced apart from the chamfered edge; and the notch is provided on a side of the chamfered edge close to the bottom portion.

3. The speaker device as described in claim 2, wherein the diaphragm comprises a vibrating portion provided with a through hole, a suspension portion extending from an outer periphery of the vibrating portion and surrounding the vibrating portion, a fixing portion bending and extending from a side of the suspension portion away from the vibrating portion and fixed to the frame, and a dome located in the through hole; and the bottom wall connects the vibrating portion and the dome.

4. The speaker device as described in claim 3, wherein the vibrating portion comprises a gluing member provided at a position corresponding to the chamfered portion and bending and extending toward the magnetic circuit unit; the gluing member is provided with a fixing post that is provided at a position corresponding to the notch and extends towards the notch; the gluing member is fixed to and connected to the chamfered portion; and the fixing post is accommodated in the notch.

5. The speaker device as described in claim 1, wherein the vibration unit further comprises an elastic conductive assembly fixed to the frame and an end of the holder away from the diaphragm;

the elastic conductive assembly comprises an elastic conductive body connected to the frame and an end of one of the pair of side walls away from the diaphragm, a connecting arm bending and extending from the elastic conductive body toward the accommodating space along one of the pair of side walls, and a pad connected to the connecting arm; and the pad is fixed to and connected to a side of the bottom wall away from the diaphragm.

6. The speaker device as described in claim 5, wherein the connecting arm comprises a first bending portion bending and extending from the elastic conductive body toward the bottom wall and a second bending portion bending and extending from the first bending portion toward the voice coil; the first bending portion and one of the pair of side walls are spaced apart in parallel; and the second bending portion and the pad are respectively connected to a side of the bottom wall away from the diaphragm.

7. The speaker device as described in claim 1, wherein the magnetic circuit unit comprises a yoke, a main magnet fixed to the yoke, a peripheral magnet surrounding the main magnet and spaced apart from the main magnet to form the magnetic gap, a first magnetic conductor fixedly covering the main magnet, and a second magnetic conductor fixedly covering the peripheral magnet; the second magnetic conductor is fixed to and connected to a side of the frame away from the diaphragm; and the second magnetic conductor is provided with an avoiding portion at a position corresponding to the pad.

* * * * *